United States Patent [19]

Matsuki et al.

[11] 4,229,675

[45] Oct. 21, 1980

[54] COLOR PICTURE TUBE WITH INTERNAL FUNNEL SHAPED MAGNETIC SHIELD

[75] Inventors: Takeshi Matsuki, Mobara; Koichi Maruyama, Chiba; Kuniharu Osakabe, Mobara; Sakae Kunitoh, Chiba, all of Japan

[73] Assignee: Hitachi, Ltd., Japan

[21] Appl. No.: 919,608

[22] Filed: Jun. 27, 1978

[30] Foreign Application Priority Data

Jul. 1, 1977 [JP] Japan ..... 52-77914

[51] Int. Cl.[2] ..... H01J 29/06

[52] U.S. Cl. ..... 313/402; 313/479; 315/85

[58] Field of Search ..... 313/479, 407, 402; 315/8, 85

[56] References Cited

U.S. PATENT DOCUMENTS

| | | | |
|---|---|---|---|
| 3,564,329 | 2/1971 | Vetz | 315/8 |
| 3,867,668 | 2/1975 | Shrader | 313/402 X |
| 4,019,085 | 4/1977 | Sakata | 313/479 X |

*Primary Examiner*—Palmer C. Demeo

*Attorney, Agent, or Firm*—Craig and Antonelli

[57] ABSTRACT

An in-line stripe type color picture tube comprises an inner magnetic shield member having sufficient shield effect against both individual vertical and horizontal components of the earth magnetism and composite components as well. The inner magnetic shield member prevents unwanted shifts of electron beams to ensure that the positional relationship between a fluorescent screen and landing electron beams may have sufficient tolerances and color blur on the fluorescent screen may be prevented.

10 Claims, 15 Drawing Figures

COLOR PICTURE TUBE WITH INTERNAL FUNNEL SHAPED MAGNETIC SHIELD

This invention relates to a color picture tube and more particularly to a color picture tube having an improved construction of a magnetic shield member incorporated in the bulb of the color picture tube for shielding external magnetism.

Prior to describing a color picture tube of the invention in comparison with a prior art, a brief description of the accompanying drawings will first be given herein.

Figure 5A:
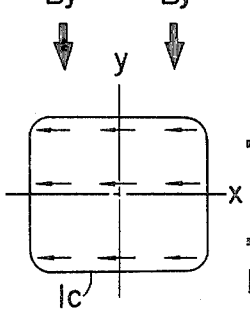
FIG.5a PRIOR ART
Figure 5B:
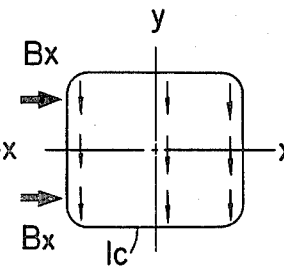
FIG.5b PRIOR ART
Figure 5C:
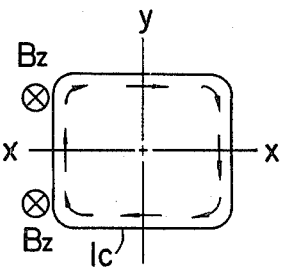
FIG.5c PRIOR ART
Figure 6A:
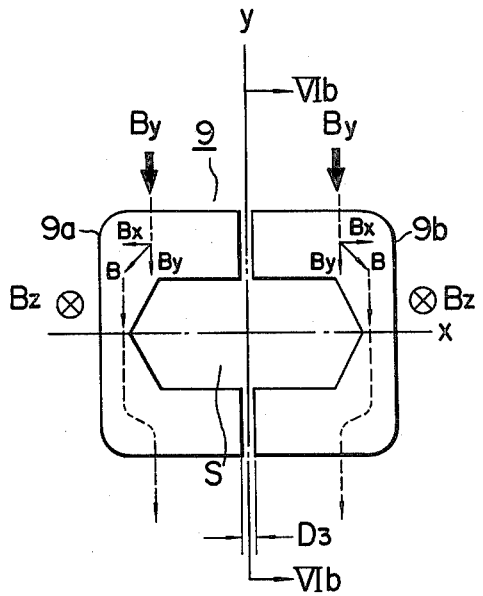
Figure 6B:
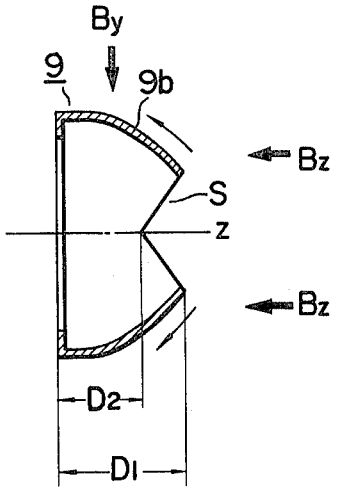
Figure 7A:
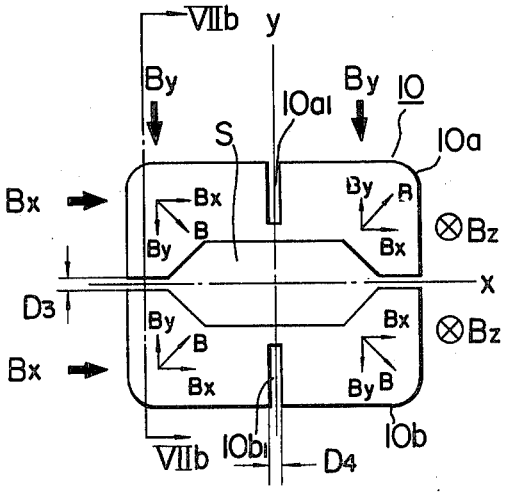
Figure 7B:
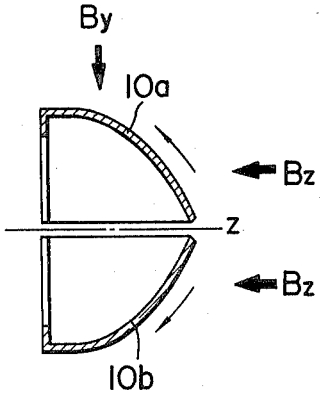
Figure 8:
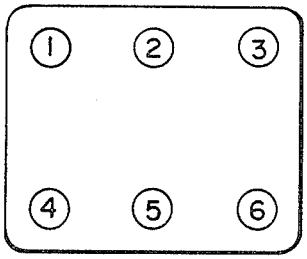
Figure 9:
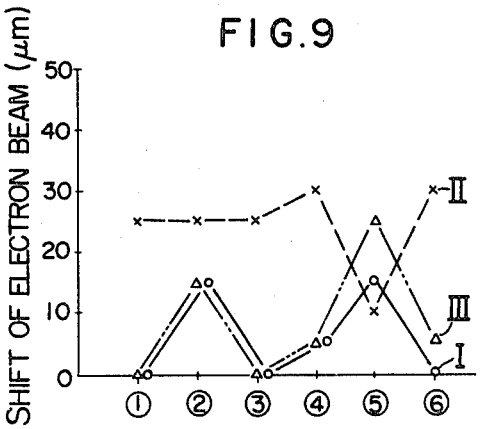
Figure 10:
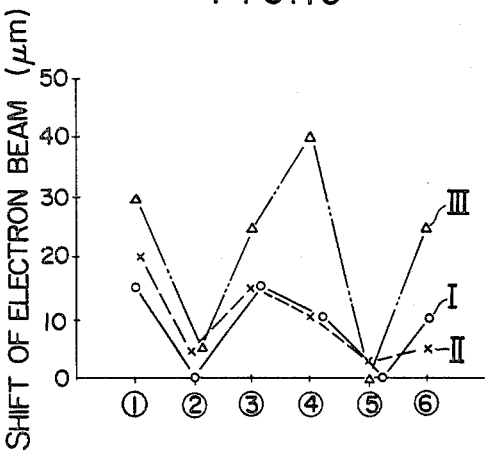
Figure 11:
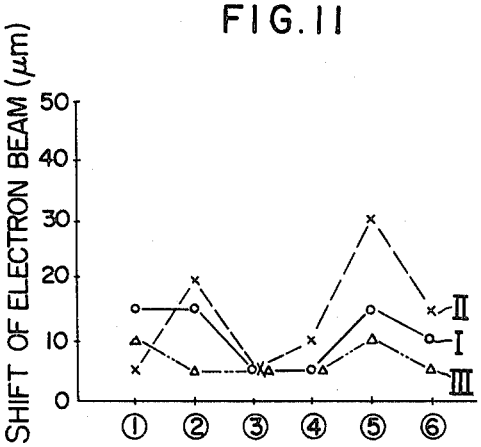

FIG. 5*a* to 5*c* are diagrammatic representations useful to explain shifts of electron beams landing on the fluorescent screen which are caused by the earth magnetism;

FIG. 6*a* is a rear view of one embodiment of an inner magnetic shield member according to the invention;

FIG. 6*b* is a sectional view of FIG. 6*a* taken on line VI*b*—VI*b*;

FIG. 7*a* is a rear view of another embodiment of an inner magnetic shield member according to the invention;

FIG. 7*b* is a sectional view of FIG. 7*a* taken on line VII*b*—VII*b*;

FIG. 8 is a diagrammatic representation showing positions at which shift of the electron beam is measured; and FIGS. 9 to 11 are graphical representations showing shifts of the electron beams measured with the inner magnetic shield member of the invention in comparison with those measured with the prior art inner magnetic shield member.

Figure 1:
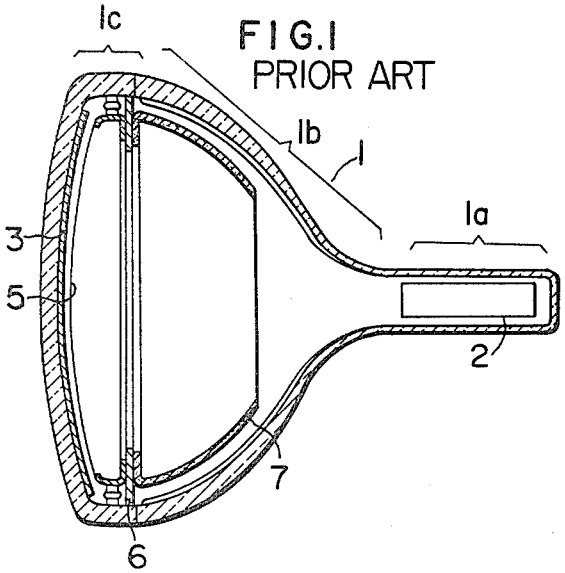
FIG.1 PRIOR ART
FIG. 1 is a sectional view of essential parts of a prior art color picture tube.
Figure 2:
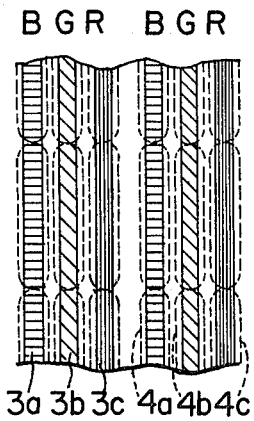
FIG.2 PRIOR ART
FIG. 2 is a plan view of essential parts of a fluorescent screen of the prior art color picture tube.
Figure 3:
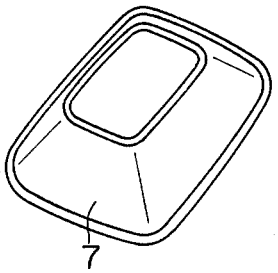
FIG.3 PRIOR ART
FIG. 3 is a perspective view of a prior art integral type inner magnetic shield member.

In general, a color picture tube comprises, as shown in FIG. 1, a glass bulb 1 having a neck portion 1*a*, a funnel portion 1*b*, and a panel portion 1*c* for hermetically sealing a large diameter opening of the funnel portion 1*b*. An electron gun assembly 2 is incorporated in the neck portion 1*a* and a fluorescent screen 3 is coated on the inner surface of the panel portion 1*c*. The fluorescent screen 3 comprises, as shown in FIG. 2, a plurality of triads of vertical stripe phospor elements 3*a* to 3*c*, blue (B), green (G) and red (R), spaced apart from each other by a predetermined distance. Three beams of electron 4*a* to 4*c* from the electron gun assembly 2 impinge upon the corresponding phosphor elements 3*a* to 3*c* of the triad to produce a color picture display. Opposed to the fluorescent screen 3 is a shadow mask 5 with a predetermined spacing. Since some of incident electron beams overscan the shadow mask 5, resulting in reflected electrons or producing secondary electrons, the shadow mask 5 is arranged to oppose, on its rear side, an electron shield member 6 for preventing impingement of those reflected electrons and secondary electrons upon the fluorescent screen 3. The electron shield member 6 in turn opposes, on its rear side, an inner magnetic shield member 7 made of a ferromagnetic material as shown in FIG. 3. The inner magnetic shield member 7 serves to prevent color blur due to failure of registration of the electron beams 4*a* to 4*c* with the phosphor elements 3*a* to 3*c*, that is, landing error which is caused by movements of the electron beams 4*a* to 4*c* perpendicular to the effective direction of a magnetic field external of the bulb 1 such as the earth magnetism. Usually, an integral type inner magnetic shield member 7 as shown in FIG. 3 is employed which is fabricated by drawing a soft steel plate having a thickness of 0.1 to 0.15 mm. This type of inner magnetic shield member, however, is disadvantageous because of its considerably high production cost.

Figure 4:
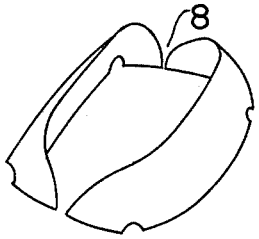
FIG.4 PRIOR ART
FIG. 4 is a perspective view of a prior art separation type inner magnetic shield member.

An approach to this problem was a separation type inner magnetic shield member 8 as shown in FIG. 4 and many applications to color picture tubes, especially of in-line stripe type, have been made. This separation type is disclosed, for example, in Japanese Pat. Appln. Kokai (Laid-Open) No. 18165/77, assigned to the assignee of the present invention.

The separation type inner magnetic shield member 8, however, was defective in having insufficient shield effect against separate and combined vertical and horizontal components of the earth magnetism as detailed below with reference to FIGS. 5*a* to 5*c*. As shown in FIG. 5*a*, in relation to vertical stripe phosphor elements 3*a* to 3*c* of the fluorescent screen 3 formed on the inner surface of the panel portion 1C as illustrated in FIG. 2, the electron beams are caused to shift, directed towards an arrow in the x-axis direction, by vertical components (y-axis) of the earth magnetism $\vec{By}$ on the basis of Fleming's left hand law, imposing serious problems on the landing of electron beams (here, $\vec{B}$ means a vector). Horizontal (x-axis) components of the earth magnetism $\vec{Bx}$ causes, as shown in FIG. 5*b*, the electron beams to shift in the direction of an arrow in the y-axis direction, imposing no serious problems on the beam landing. Further, z-axis earth magnetism $\vec{Bz}$, in particular, the horizontal components thereof cause the electron beams to move along the periphery of the fluorescent screen, imposing serious problems on the beam landing. As described above, it will be appreciated that the x-axis earth magnetism $\vec{Bx}$ will not affect the beam landing but y-axis and z-axis earth magnetisms $\vec{By}$ and $\vec{Bz}$ will adversely affect the electron beams 4*a* to 4*c* each extending in the y-axis direction, causing color blur due to landing error on the phosphor elements 3*a* to 3*c*.

It is explained in Japanese UM Appln. Kokai (Laid-Open) No. 133857/75 how earth magnetism affects the movement of electron beams.

Therefore, the invention contemplates to eliminate the above prior art drawbacks and has its object to provide an in-line stripe type color picture tube having a low cost inner magnetic shield member which makes full use of the nature of such an in-line stripe type and has a sufficient magnetic shield effect against individual and combined vertical and horizontal components of the earth magnetism.

According to the invention, the above object can be accomplished by providing a color picture tube with an inner magnetic shield member having a high reluctance portion. The invention will now be described in more detail by way of examples with reference to FIGS. 6*a*, 6*b*, 7*a* and 7*b*.

An inner magnetic shield member 9 as shown in FIGS. 6*a* and 6*b* comprises two identical shield parts 9*a* and 9*b* which intersect the scanning direction (raster direction) of the electron beam substantially at right angles and are symmetrical with respect to the y-axis, the long sides having a height $D_1$ as large as 1.2 to 1.5 times a height $D_2$ of the short sides. The two shield parts 9*a* and 9*b* are fixed symmetrically with respect to the y-axis with the interposition of a gap $D_3$ of a 30 mm width establishing a high reluctance portion.

With the color picture tube of this construction, since the inner magnetic shield member 9 has two symmetrical separations which intersect the scanning direction of the electron beam substantially at right angles and which have long sides having the height $D_1$ 1.2 to 1.5 times higher than the height $D_2$ of short sides, the y-axis earth magnetism $\vec{By}$ coming into an electron beam travel region S can be shielded to reduce the shift of the electron beams in the x-axis direction. In addition, the symmetrical disposition of the two shield parts 9*a* and 9*b* through the high reluctance gap $D_3$ forces the y-axis earth magnetism $\vec{By}$ coming into the shield parts 9*a* and 9*b* to divide the y-axis component By running along each shield part of low reluctance into an x-axis component not effecting the movement of electron beams and the divisional component thereof B. The flow B on each separation is directed toward the short side of each separation 9*a*, 9*b* and is then curved at the corner thereof, tracing a path designated by a dotted curve to generate the x-axis component Bx and finally leaving the separation. Accordingly, the electron beam travel region S is freed from the y-axis earth magnetism $\vec{By}$, minimizing the shift of the electron beam in the x-axis direction. The z-axis earth magnetism $\vec{Bz}$ coming into the shield parts 9*a* and 9*b* is forced to run along the curved surface of these shield parts by the 30 mm width central high reluctance gap $D_3$ thereby to generate a y-axis component By. However, the shift of the electron beam due to the y-axis component By is cancelled at by that of electron beam due to the z-axis component Bz so that substantial shield effect against the z-axis component Bz can be achieved.

In this manner, it is possible to minimize the peripheral movement of electron beams due to the z-axis earth magnetism $\vec{Bz}$ and hence the color blur on the flourescent screen. The provision of the gap having a width of 30 mm suppresses the generation of the y-axis component By of the x-axis earth magnetism $\vec{Bx}$. The dimension of width of the gap $D_3$ is critical because, if it is more than 30 mm the shield effect against the y-axis earth magnetism and z-axis earth magnetism is decreased owing to leakage. Conversely, if it is less than 30 mm gap width, the shield effect to the x-axis component Bx is also decreased to the order of the prior art shield member due to the decrease of the reluctance in the gap.

Referring now to FIGS. 7*a* and 7*b*, another embodiment of the invention comprises an inner magnetic shield member 10 having upper and lower identical shield parts 10*a* and 10*b* which are symmetrical with respect to the x-axis with a gap $D_3$ having a width of 30 mm. The shield parts 10*a* and 10*b* are formed with vertical slits $10a_1$ and $10b_1$, respectively, at their central portions. The slits have a height as large as 50 to 90% of a height of the shield parts and a width $D_4$ of 10 to 30 mm.

With this construction, an x-axis component Bx of x-axis earth magnetism $\vec{Bx}$ coming into the shield parts 10*a* and 10*b* is suppressed to flow by the y-axis slits $10a_1$ and $10b_1$ intersecting the flow direction of the component Bx, thereby suppressing a y-axis component By from occurring. Accordingly, it is possible to minimize the shift of electron beam in the x-axis direction due to the y-axis component By. Flow of y-axis component of y-axis earth magnetism $\vec{By}$, on the other hand, is prevented by the high reluctance gap $D_3$ intersecting the flow direction of the component By. In this case, an x-axis component Bx and a divisional component B due to the component By are almost suppressed from occurring and their flows are prevented by the slits $10a_1$ and $10b_1$. Accordingly, it is possible to minimize the shift of the electron beam in the x-axis direction due to the y-axis component By. The z-axis earth magnetism $\vec{Bz}$ comes into the separations as shown in FIG. 7*b* along curved surfaces of the separations 10*a* and 10*b* to generate its x-axis component Bx, y-axis component By and the divisional component thereof. However, the shift of the electron beam due to the y-axis component is cancelled out for the same reason as in the embodiment of FIGS. 6*a* and 6*b* so that a substantial shield effect againt the z-axis component can be achieved.

Consequently, the inner magnetic shield member 10 improves the magnetic shield effect and suppresses color blur on the flourescent screen considerably.

Shifts of the electron beams were measured at locations ① to ⑥ shown in FIG. 8 with the inner magnetic shield members 9 and 10 and the prior art inner magnetic shield members 7 and 8. Results are shown in FIGS. 9, 10 and 11. These results were obtained by applying the above inner magnetic shield members to a 20 inch 110° deflection in-line stripe type color picture tube. In FIGS. 9 to 11, characteristic I represents shifts of the electron beam obtained with the inner magnetic shield members 9 and 10 of the invention, characteristic II represents shifts of the electron beam obtained with the prior art integral type inner magnetic shield member 7, and characteristic III represents shifts of the electron beam obtained with the prior art separation type inner magnetic shield member 8. For obtaining data in FIG. 9, the scanning direction of the electron beam was aligned with the south-north direction of the earth magnetism. For data in FIG. 10, the scanning direction was aligned with the east-west direction of the earth magnetism and for data in FIG. 11, a vertical magnetic field of 0.45 gauss was applied.

As will be seen from FIGS. 9 to 11, the characteristic I of inner magnetic shield members 9 and 10 of the invention generally enjoys superior shield effects to characteristics II and III of prior art inner magnetic shield members 7 and 8.

The invention is by no means limited to the inner magnetic shield members as in the foregoing embodiments and the same effect may be attained when the invention is applied to an outer magnetic shield member.

As described above, the in-line stripe type color picture tube with the inner magnetic shield member according to the invention can considerably suppress the shift of the electron beams against each and both of vertical and horizontal components of the earth magnetism and ensure sufficient tolerances for register of the electron beams with the phosphor elements, thereby improving quality and performance of color picture tubes. Further, the separation type of inner magnetic shield member can be fabricated at low cost and thus improve productivity.

What we claim is:

1. An in-line stripe type color picture tube comprising:

a bulb including a neck portion, a funnel portion and a panel portion for hermetically sealing a large diameter opening of the funnel portion, an electron gun assembly disposed in the neck portion of the bulb, a fluorescent screen formed on the inner surface of the panel portion, a shadow mask disposed in the bulb and opposing the fluorescent screen with a predetermined spacing, a magnetic shield member in the form of a funnel opposing the shadow mask and extending along the curvature of the funnel portion for surrounding a travel region of electron beams emitted from the electron gun assembly, said magnetic shield member having a transverse cross-sectionally central portion defining an area of a predetermined, substantially constant width and a higher reluctance than that of the magnetic shield member, said higher reluctance area perpendicularly intersecting a scanning direction of the electron beams.

2. An in-line stripe type color picture tube according to claim 1, wherein said magnetic shield member is divided into two shield parts by said high reluctance area.

3. An in-line stripe type color picture tube according to claim 2, wherein said high reluctance portion comprises gaps between portions of said shield parts having a width of 30 mm.

4. An in-line stripe type color picture tube according to claim 1, wherein said high reluctance area comprises slits cut from the periphery of said magnetic shield member.

5. An in-line stripe type color picture tube according to claim 4, wherein each said slit has a height as large as 50 to 90% of a height of said magnetic shield member and a width of 10 to 30 mm.

6. An in-line stripe type color picture tube according to claim 1, 2 or 3 wherein said magnetic shield member has long sides having a height as large as 1.2 to 1.5 times a height of the short sides.

7. An in-line stripe type color picture tube according to claim 1, 2, 3, 4, or 5 wherein said high reluctance area is provided substantially at the central portion of said magnetic shield member in the scanning direction of the electron beams.

8. An in-line stripe type color picture tube according to claim 6, wherein said high reluctance area is provided substantially at the central portion of said magnetic shield member in the scanning direction of the electron beams.

9. An in-line stripe type color picture tube according to claim 2, wherein said magnetic shield member is formed by two shield parts separated by gaps between portions of said shield parts and wherein said high reluctance area comprises said gaps and slits cut from the periphery of said magnetic shield member.

10. An in-line stripe type picture tube according to claim 9, wherein said gaps have a width of 30 mm and said slits have a width of 10 to 30 mm.

* * * * *